US006349883B1

(12) United States Patent
Simmons et al.

(10) Patent No.: US 6,349,883 B1
(45) Date of Patent: Feb. 26, 2002

(54) ENERGY-SAVING OCCUPANCY-CONTROLLED HEATING VENTILATING AND AIR-CONDITIONING SYSTEMS FOR TIMING AND CYCLING ENERGY WITHIN DIFFERENT ROOMS OF BUILDINGS HAVING CENTRAL POWER UNITS

(75) Inventors: Michael Lee Simmons, Sarasota, FL (US); Dominick J. Gibino, Manassas, VA (US)

(73) Assignee: Energy Rest, Inc., Manassas, VA (US)

( * ) Notice: Subject to any disclaimer, the term of this patent is extended or adjusted under 35 U.S.C. 154(b) by 0 days.

(21) Appl. No.: 09/488,702

(22) Filed: Jan. 21, 2000

Related U.S. Application Data

(63) Continuation-in-part of application No. 09/246,723, filed on Feb. 9, 1999, now Pat. No. 6,179,213.

(51) Int. Cl.[7] ..... F24F 3/00; G05D 23/00
(52) U.S. Cl. ..... 236/46 R; 236/51; 165/209
(58) Field of Search ..... 236/51, 41, 46 R, 236/49.3; 165/217, 208, 209

(56) References Cited

U.S. PATENT DOCUMENTS 5,165,465 A * 11/1992 Kenet ..... 236/47 X
5,538,181 A 7/1996 Simmons et al. ..... 236/51
5,603,758 A * 2/1997 Lincoln et al. ..... 236/47 X
5,711,480 A 1/1998 Zepke et al. ..... 236/51
6,009,939 A 1/2000 Nakanishi et al. ..... 165/209

* cited by examiner

*Primary Examiner*—William Wayner
(74) *Attorney, Agent, or Firm*—Breiner & Breiner, L.L.C.

(57) ABSTRACT

An automated energy saving system dispenses HVAC energy from a common energy source to a set of utility zones, typically rooms in a house or commercial building which are dispersed at different locations remote from the energy source, typically a roof top unit. Each utility zone selects locally established operating conditions as operating parameters serviced at a control center, typically located at the energy source site, to distribute available HVAC energy to the independent utility zones of the set in an energy saving mode of operation. The remote utility zones communicate with the common controller by wiring or wireless communication links. At the energy source energy is distributed by off-on control of individual energy conduits to the individual utility sites. The control parameters at the local utility zones define energy-off periods by way of predetermined interactively set temperature ranges in one preferred automated delivery mode for delivering both heating and cooling energy from the HVAC energy source. Timing cycles for energy delivery during reduced energy delivery periods are also interactively defined at local utility sites for initiating automatic control functions at the central control site. Typically energy is supplied intermittently during uninhabited periods at local utility zones in response to either passive temperature range settings or dynamic occupancy detectors to conserve energy in an energy savings mode of operation.

11 Claims, 3 Drawing Sheets

ENERGY-SAVING OCCUPANCY-CONTROLLED HEATING VENTILATING AND AIR-CONDITIONING SYSTEMS FOR TIMING AND CYCLING ENERGY WITHIN DIFFERENT ROOMS OF BUILDINGS HAVING CENTRAL POWER UNITS

This is a continuation-in-part of our co-pending application Ser. No. 09/246,723 filed Feb. 9, 1999 now U.S. Pat. No. 6,179,213 for UNIVERSAL ACCESSORY FOR TIMING AND CYCLING HEAT, VENTILATION AND AIR CONDITIONING ENERGY CONSUMPTION AND DISTRIBUTION SYSTEMS.

TECHNICAL FIELD

This invention relates to energy saving in heating ventilating and air-conditioning (HVAC) systems, and more particularly it relates to selective distribution of HVAC energy from a central HVAC power unit to various remotely located utility output channels such as individual rooms in a building in response to local control parameters featuring operation temperature, energy cycling periods and occupancy status.

BACKGROUND ART

Local in-room air conditioners for individual rooms such as hotel rooms have been controlled automatically from in-room motion detecting power control units to produce energy savings as disclosed in U.S. Pat. No. 5,538,181 granted Jul. 23, 1996 to Michael L. Simmons, et al. for AUTOMATIC ROOM OCCUPANCY CONTROLLED FUEL SAVINGS SYSTEM FOR AIR CONDITIONING/HEATER UNITS.

Our pending parent application U.S. Ser. No. 09/246,723 filed Feb. 9, 1999 now U.S. Pat. No. 6,179,213 for UNIVERSAL ACCESSORY FOR TIMING AND CYCLING HEAT, VENTILATION AND AIR CONDITIONING ENERGY CONSUMPTION AND DISTRIBUTION SYSTEMS provides an inexpensive, comprehensive, universally applicable programmable retrofit accessory for interactively controlling established thermal/ventilating systems to implement designated energy releasing parameters such as operating temperature, operating control cycle periods and site occupancy for selectively delivering HVAC energy at a common energy source and utility site such as a home or hotel room with a resident HVAC energy supply unit. Provisions are made for long range energy control at an inactive occupancy site such as an uninhabited vacation home, which is used sporadically, thereby to protect indoor plumbing from freezing with reduced energy costs, etc.

However this background art is not suitable in more complex HVAC systems such as those with rooftop HVAC energy sources serving different rooms or zones in a residence or commercial building for simply and inexpensively optimizing energy savings by coordination of multiple energy delivery conduits active in these systems. There remains a significant unsolved problem of optimizing energy savings in complex HVAC energy supply systems serving multiple energy output channels at different localities from a central HVAC source. Thus, the control units which have been restricted to individual control of a single HVAC energy delivery source at the energy delivery site do not optimize energy savings in systems where a common HVAC energy source such a rooftop unit serves a set of remotely residing thermostatically controlled rooms or zones having different uncoordinated energy demands that are likely to cause system operating problems such as failures when exceeding peak capacity or inability at times to produce sufficient HVAC energy demands at various utility sites being served.

Although electronically controlled and computerized automated HVAC control and energy distribution systems for different rooms or regions from remote HVAC conditioners are well known in the prior art, there is no known inexpensive and simply retrofittable system control accessory that coordinates or controls the system for optimizing energy savings as a function of occupancy at a plurality of utility sites for generating energy savings. In particular, In particular, complex HVAC energy control systems have not coordinated multiple energy outlets for energy savings, nor have they initiated modes of operation saving energy as a function of occupancy at diverse energy delivery sites.

Typical of the conventional HVAC system prior art is U.S. Pat. No. 6,009,939 by R. Nakanishi, et al., granted Jan. 4, 2000 for DISTRIBUTED AIR CONDITIONING SYSTEM. This system employs a central monitoring and control board for several sources of heat energy supplying different rooms or zones to be air conditioned. However, this system operates with only the temperature input parameter and furthermore does not disclose an energy savings mode of operation.

Another such U.S. Pat. No. is 5,711,480 granted Jan. 27, 1998 to B. E. Zepke, et al. for LOW-COST WIRELESS HVAC SYSTEMS. A master control system is therein wirelessly connected to control several utility centers such as rooms in a residence or hotel from a remote common HVAC energy source. This system also fails to operate in an energy savings mode and fails to address multiple interactively designated control parameters at the several local energy delivery sites.

Thus, this conventional type of prior art does not provide systems for optimizing energy savings systems. Nor does it address and coordinate multiple interacting control parameters or sporadic habitation of the energy utility sites being controlled. It does not address problems related to automatic reduction of energy in the absence of occupancy such as found in sporadically used vacation residences, commercial buildings unoccupied at night, hotels with variable occupancy in leased rooms, and the like.

Therefore, it is an objective of this invention to automatically control the HVAC energy dispensed to a plurality of utility zones such as rooms remotely located from a central energy delivery and control system that responds to multiple control parameters including occupancy of various remotely located energy utility sites.

It is another object of this invention to provide automated HVAC controls for optimizing energy savings by interactive local temperature ranges and energy on-off cycling times coordinated for a multiplicity of remote system wide utility sites while avoiding operating failures such as overloads of the HVAC energy supply source.

Other objects, features and advantages of the invention will be found throughout the remaining description and the accompanying drawings and claims.

DISCLOSURE OF THE INVENTION

A comprehensive automated HVAC energy delivery system is afforded by this invention to distribute energy available from a central common HVAC energy source to a set of remote utility zones, such as rooms in a house or hotel or in different locations in a commercial building, in response to independent control parameters established locally at the various utility zones in the set. Thus a retrofittable universal type control unit typically located at the common energy source site controls distribution of HVAC energy in response to input control parameters derived in-situ from local control units at the utility zones remotely positioned from the energy source site.

Energy distribution is controlled as a function of local temperature requirements and timing cycles of a nature interactively specified from individual control units at the various local energy utility sites remotely positioned from a common energy source site for the system, Independent control parameters at each utility site are coordinated for system operation in an energy saving mode.

Provisions are made for reducing energy as a function of utility site occupancy by reducing or switching off energy delivery from the common HVAC energy source to the individual utility sites during uninhabited or inactive periods in response to both (a) passively scheduled periods of reduced energy delivery in response to local temperature range settings for choosing both high and low alarm levels, thereby specifying a temperature range for delivering reduced energy and (b) in response to active and dynamic occupancy detection at the local utility sites, such as with motion detectors.

Other objects, advantages and features of the invention will be found throughout the following drawings, description and claims.

BRIEF DESCRIPTION OF THE DRAWINGS

In the accompanying drawing wherein like reference characters represent similar features throughout the various views to facilitate comparison.

THE PREFERRED EMBODIMENTS

Figure 1:
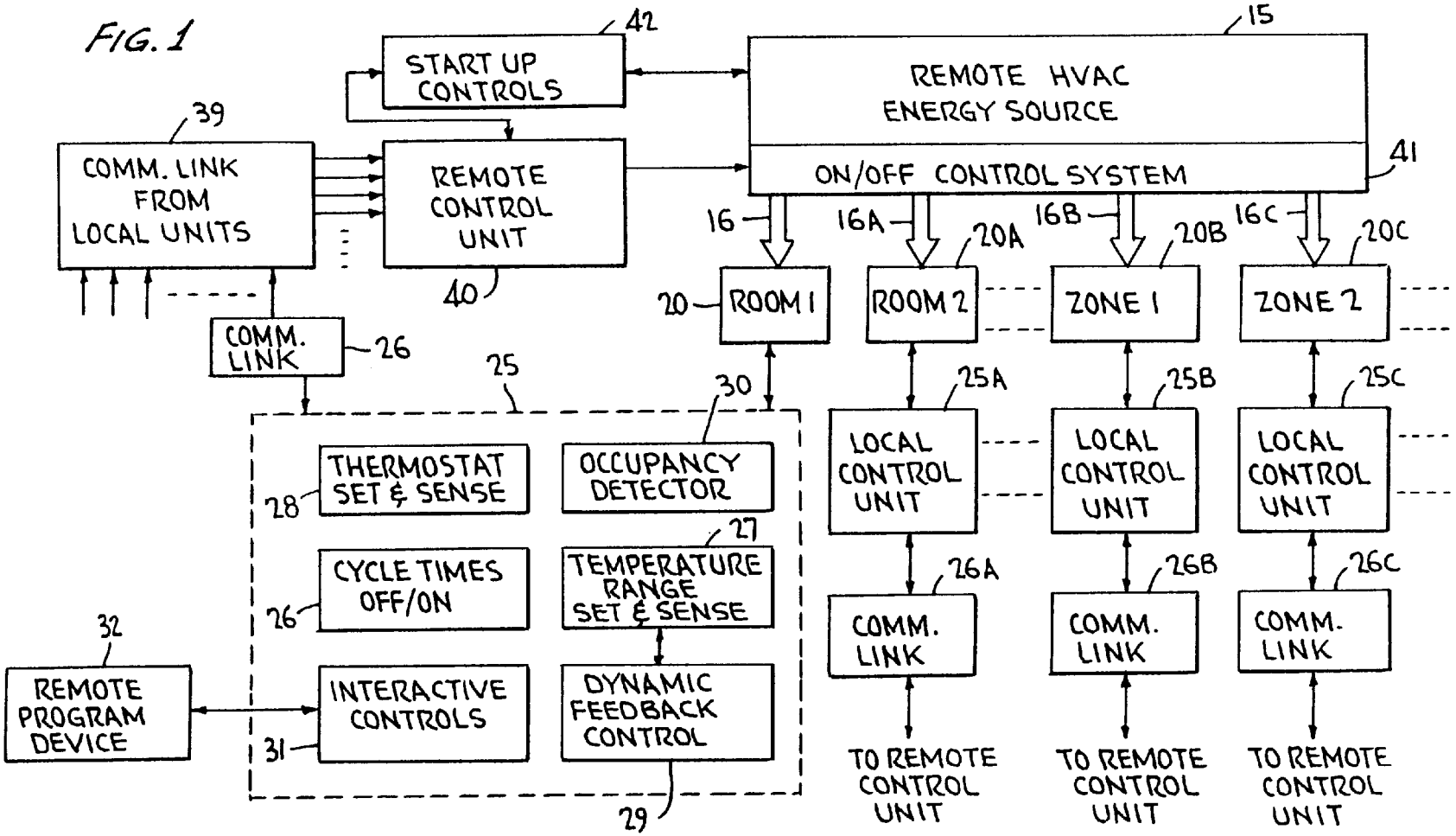
FIG. 1 is a block system diagram of the energy saving system afforded by this invention.

As may be seen in FIG. 1, the HVAC energy source 15 is remotely located from the various rooms and other control zones 20, 20A, etc. individually receiving HVAC energy delivered from source 15 via the energy conduits 16, 16A, etc. Typically the HVAC energy source 15 is a rooftop installation servicing a residence or commercial building with various rooms and zones 20 requiring independent amounts of energy at different timing schedules and based upon diverse energy control parameters. For example office rooms or hotel rooms may be occupied during scheduled and leased periods; kitchens, offices and production facilities may be active during different scheduled hours; etc. This system coordinates the energy requirements from the HVAC energy source 15 in an energy savings mode to operate efficiently while meeting the individual local in-situ requirements and control parameters specified at the various local control units 25, 25A, etc.

Significant energy savings are effected by introducing the occupancy factor 30 into the control system, although this overall system also provides more generally energy savings by coordinated distribution of energy from the remote HVAC energy source 15 to satisfy and coordinate independent energy requirements of the various rooms and zones (20). For example, the peak system loading of the remote HVAC energy source may be significantly reduced by coordinated controls to accommodate lower capacity and thereby save energy.

The Automatic Room Occupancy Fuel Savings System of U.S. Pat. No. 5,538,181 provides for separate in-room thermostat controlled operations for controlling on-off switching of energy provided from HVAC energy delivery dampers located in each room, and thus does not provide for coordinated system wide control of the energy delivery dampers in an energy saving mode of operation.

Our co-pending parent application Ser. No. 09/246,723 Filed Feb. 9, 1999 provides a computerized, substantially universal plug-in accessory programmable as a mating accessory to an HVAC energy source for timing and cycling the delivery of energy from an in-room HVAC energy source through control signals by actuating electric power switches, fluid flow valves, air flow control vanes, etc. This foreground technology is incorporated into this disclosure in its entirety by reference.

Thus, the block diagram of FIG. 1 herein describes in the various blocks features enabling those skilled in the art to implement the HVAC energy saving system herein disclosed and claimed. The above referenced background patents in general indicate the level or skill in the related art of HVAC system operation technology.

The present HVAC control system has the HVAC energy unit 15 remotely located from each of the energy utilization zones 20 in which delivered energy is automatically controlled by the energy saving system afforded by this invention. Local control units 25 located in-situ with each of the respective controlled zones 20, 20A, etc. interactively designate local control parameters. Additionally a retrofittable remote control unit 40 is located in-situ at the HVAC energy unit 15 and employed for supervising the distribution of energy from HVAC source 15 to the various local sites 20, 20A, etc. In this respect the independent communication links 26, 26A, 26B, etc. are employed to transport the different control signals established at the independent local control units 25, 25A, etc. to the translator 39, which establishes control conditions for the HVAC energy source in the programmable automated computerized remote control unit 40. The links 26, 26A comprise state of the art communications such as electric wiring, radio transmission (U.S. Pat. No. 5,711,480) or IR communication.

In the simplified manner of distributing energy via conduits 16 from the HVAC energy source 15 to the independent zones 20, 20*a*, etc., the interspersed on/off control and distribution system 41 is programmed to deliver energy at specified coordinated times to the respective controlled zones 20, 20A, etc. This is simply done in different types of HVAC energy delivery systems, such as by state of the art damper controls described in the above disclosed U.S. Pat. No. 5,711,480 and the like.

This simplified system provides protection against various energy control problems encountered in systems of this type and operates with a common centrally controlled energy delivery site 40 for controlling and coordinating in this comprehensive system the delivery of energy under locally specified energy conditions requiring unrelated, unsynchronized energy delivery times in the different utility center sites 20. Conventional techniques such as the start-up controls 42 are employed typically to protect HVAC energy compressor units from start-up under maximum power drain conditions, typically by imposing random or coordinated delays between start-up intervals in the several utility sites 20.

However the demands herein imposed for maximizing energy savings in such complex systems impose new problems that are herein addressed and solved. Thus, the typical conditions and circumstances encountered to be controlled by a truly universal system embraces a wide range of control parameters individually specified at local utility units 20 being heated or air conditioned. Each one of the utility zones 20, 20A, etc. being independently controlled by the local control units 25, 25A, etc. thus may have a great diversity of locally defined parameters requiring changes in control and delivery of HVAC energy to introduce an energy saving mode of operation. By avoiding the accumulation of all worst case conditions simultaneously in an uncoordinated system, this system typically eliminates a conventional system design requirement for such a large energy supply unit capacity that supplied energy cost is increased rather than decreased.

Also individual interactively selectable conditions 25 for the various controlled zones 20, 20A, etc. present significant challenges, such as when many zones in a commercial building need to increase the inactive standing rate of delivery of energy at a specified starting time each day. Thus the remote control unit 40 is signaled to multiplex the delivery times of energy to individual utility zones 20 thereby to reduce the peak load capacity of the energy delivery system thus to increase energy savings.

If a building being controlled by the HVAC energy source 15 for example is a condominium, some units 20 may take vacations or business trips and leave the units unoccupied for various lengths of time. During those times temperature levels are maintained at minimum specified levels by the control system afforded by this invention, to significantly reduce energy savings as a function of local utility unit 20 occupancy status (30). The occupancy status is provided by both passive long term temperature control settings and dynamically active in-situ detectors in accordance with this invention and accordingly the energy savings may be optimized.

Where the building being serviced is a commercial building or plant, there may be different zones where common energy control conditions for temperature is desired. However, office space, production lines, restaurant facilities, etc. may have different established occupancy hours and diverse control requirements. Thus, multiple local controls (25) in both occupied and unoccupied sites are desirable to save energy. The control system afforded by this invention provides for coordinating inconsistent overlaps of energy control conditions with the focus upon energy savings.

In different climates or parts of buildings, such as underground spaces and walls with windows, there may be local utility zones with inconsistent conditions for setting temperature ranges and thus require different operating temperature ranges for switching energy on or off. Also, intermittent energy delivery cycles of predetermined frequencies and time periods of energy delivery, encompassing long time periods such as days, hours or weeks can be scheduled within a minimum temperature operation condition such as for protecting water pipes from freezing, etc. Accordingly there is an extensive range of diverse interactive controls necessary for setting and sensing cycle times and temperature ranges including provisions to override thermostat temperature control settings, to thus increase energy savings.

At the local in-situ control units 25, interactive controls 31 include provisions for setting and initiating cycle times (26), setting temperature ranges (27) within desired selection ranges either by manual actuation of wired in dials or buttons or by using a remote programming device 32 preferably of the wireless type. Thus, a room renter in a hotel could interactively make thermostat temperature range or cycling control settings for personal comfort, etc. In operation at the local utility zones 20, when the sensed local temperature is within the chosen temperatures ranges (27), temperature control operation via thermostat control section 28 is suspended in order to reduce energy expenditures at the respective local sites 20.

The remote control unit 40 is programmed to implement energy delivery as a function of several parameters. For example, the occupancy detectors 30 at the various zones 20 serve to turn on and off the energy source 15 in the corresponding zones or otherwise modify energy delivery cycle times 26 employed for example in the absence of occupants to keep within specified temperature ranges 27. Automatic regulation is achieved for modification of the temperature range limits 27 after specified periods of operation to implement a preferred energy saving mode of action in connection with the dynamic feed back controls 29 of the corresponding local control units 25. Interactively chosen limits may also be remotely established interactively from remotel program devices 32 of the nature of remote TV control devices. A typical control function exercised at the remote control unit 40 is to schedule and implement off-on energy delivery cycles (26, 41) for each utility zone 25 in response to the occupancy levels sensed at 30 within the respective zones 20.

Figure 2:
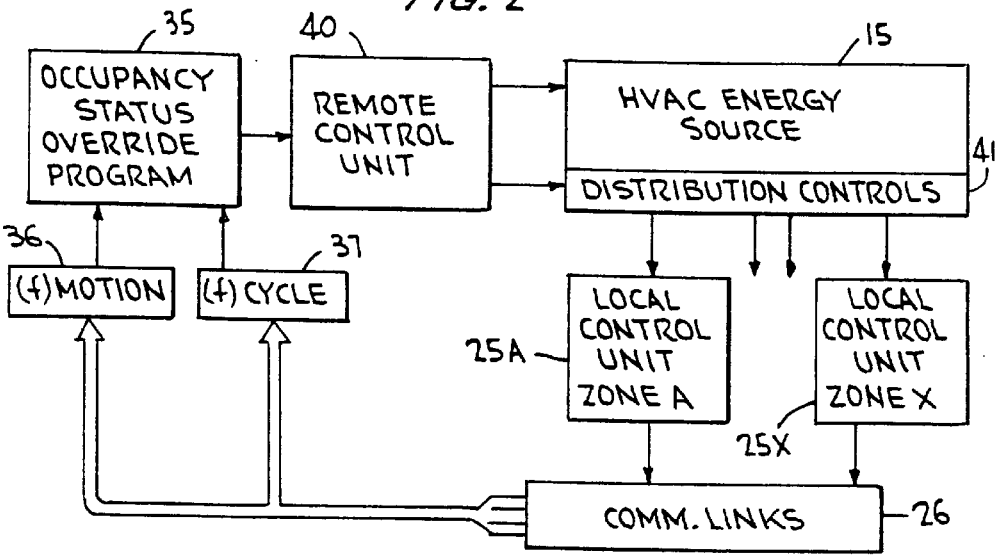
FIG. 2 is a block diagram of a system afforded by this invention for controlling distribution of HVAC energy as a function of the occupancy status in a plurality of separate habitable utility zones receiving HVAC from a common HVAC energy source.

FIG. 2 demonstrates the role of the respective local occupancy status in the distribution of energy from the common remotely located HVAC energy source 15 to the respective local utility zones (20A, 20X, etc.). The "local" "remote" terminology indicates that the temperature controlled units 20A, 20X, etc. are at different "local" locations than the common HVAC energy source 15. Thus the "remote" control unit 40 preferably is located at the location of the energy source 15, which typically could be a roof top unit on a building that supplies HVAC energy to different rooms and zones within the building comprising local zones A to X having independent local control units 25 providing for entry of energy control parameters. Those locally introduced control parameters relating to the occupancy status provide conditionally for override control of a normal thermostatically controlled mode of operation in the remote control unit 40 to establish a control mode for unoccupied local zones. The unoccupied control mode is effected by programming 35 for processing requirements of the various types of system installations through a suitable program provided at block 35. Two local control parameters address the occupancy status. The first control option introduces occupancy status as a function of motion 36, produced respectively by an active dynamic occupancy detector (30. FIG. 1), typically a motion sensor. The other control parameter initiates an intermittent energy delivery mode which is a function of a specified passive cycle pattern. This is interactively set at the local control units 25. Local cycle time instructions in the format of a long range clock for timing a prescribed energy cycling pattern for local energy control is disclosed in the parent application. This can schedule reduction of HVAC energy during vacation periods and or other uninhabited or relatively light occupancy periods for each of the local zones 25. Accordingly the communication links 26 from the multiplicity of local zones provide from the two forms of occupancy status indications 36, 37 herein parameters for the remote control unit 40 to schedule energy delivery and distribution patterns for effectuating corresponding energy distribution to the various local units in the distribution control section 41 at the HVAC central energy source 15. The local occupancy status conditions in this manner serve to preemptively override the otherwise designated control parameters set at the respective local control units 25.

Figure 3:
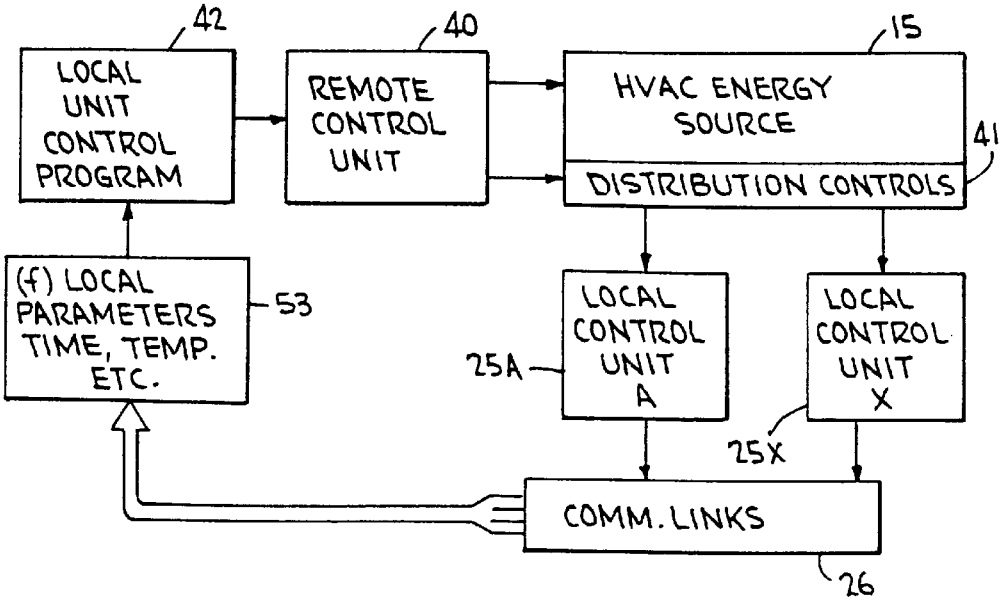
FIG. 3 is a block diagram of a system afforded by this invention for controlling distribution of HVAC energy as a function of different sets of local control parameters designated at a plurality of separate service zones receiving HVAC energy from a common HVAC energy source.

In FIG. 3, the role of the local parameters designated at the individual local control units 25A, 25X, etc. in controlling the distribution of energy (41) from the common HVAC energy source 15 is outlined. The function of local control parameters 53 derived from the local control units 25 via communication links 26 from the various local control units 25 is to trigger corresponding programming controls 42 at the remote control unit 40 for distribution of energy to the respective local zones (20) at 41 as provided by the HVAC energy source 15. Accordingly the energy requirements of each local unit (20, FIG. 1), as designated by the respective local control units 25, are implemented by the remote control unit 40 for off-on-distribution control of the HVAC energy from source 15 via the local zone distribution control block 41. Such local energy distribution is of course custom programmed to coordinate the respective arrays of local utility sources independently served by the central HVAC energy source in any particular energy control system in an operation mode for optimizing system energy savings.

Figure 4:
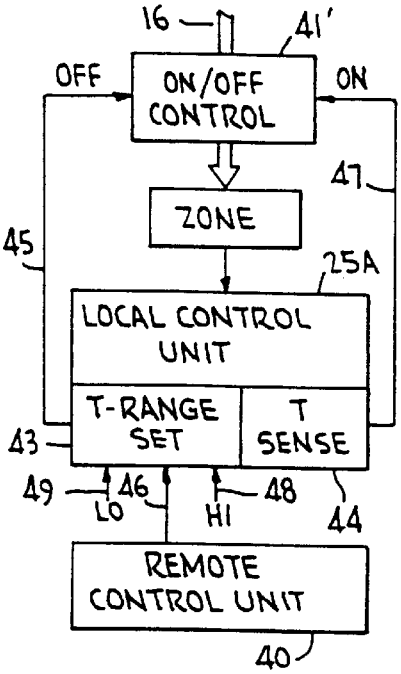
FIG. 4 is a block diagram illustrating a feature of this invention for establishing system temperature range operation limits for automatically reducing the delivery of HVAC energy to individual utility zones, typically during periods of limited occupancy.

In FIG. 4, the operation of the HVAC energy saving system of this invention in response to predetermined temperature range limits is set forth. Respective high and low temperature limits 48, 49 are set at the temperature range set block 43 by way of interactively set high 48 and low 49 temperature controls found at each particular utility zone 20A, etc. In operation, following a delay time after initial operation in an energy reducing mode, the system resets the interactively set limits established by automatic override rearrangement of the temperature operation limits initiated by the remote control unit 40 at lead 46. Thus, the remote control unit 40 re-establishes the temperature range to different limits in a preferred energy supply mode.

In automatic operation, the temperature operation limits define the temperature range (T-range) for inactivity of the automated energy delivery and thus constitutes an automatic temperature alarm initiating the choice of heating and cooling in the manner obtained in conventional thermostats by manual reset of a cooling-heating switch. When the temperature sensor 44 and its accompanying control features at the local utility zone 20A indicates a temperature reaching one temperature limit in the selected range it serves to turn on at the on-off distribution control block 41' the normal delivery of either heating or cooling HVAC energy in the conduit 16 for the respective utility zone. In other words, the T-range defines the temperature range in which the HVAC energy is blocked at the opposite ends of the controlled range and serves the switching or alarm function of a thermostat for automatically transferring from heating to cooling energy. This is simply achieved as the T-range turns off the energy from the HVAC energy source feedback through coupling link 45. Otherwise the on switch lead 47 assures thermostatic control distribution of the energy responsive to local thermal sensors 44 in the local zones 20.

Accordingly, after an appropriate delay in the normal delivery of energy, the automated feature at line 46 may reset the operating limits to a preferred operating range. For example, if a vacation house is uninhabited, a lower temperature setting might be forty-five degrees Fahrenheit to prevent pipes from freezing, and an upper limit might be ninety degrees Fahrenheit where the HVAC cooling is turned on to limit excessive humidity under summer conditions. However, the humidity could be reduced enough in a half hour of cooling to reset the range upper limit to one-hundred degrees in order to save more energy. Similarly after an hour of heating during the colder part of the early morning, the limit could be reset to 40 degrees to conserve energy without danger of freezing the pipes in contemplation of daylight warmup. Thus the remote control unit 40 by way of corresponding software is programmed to automatically monitor and readjust the T-range for local conditions.

Figure 5:
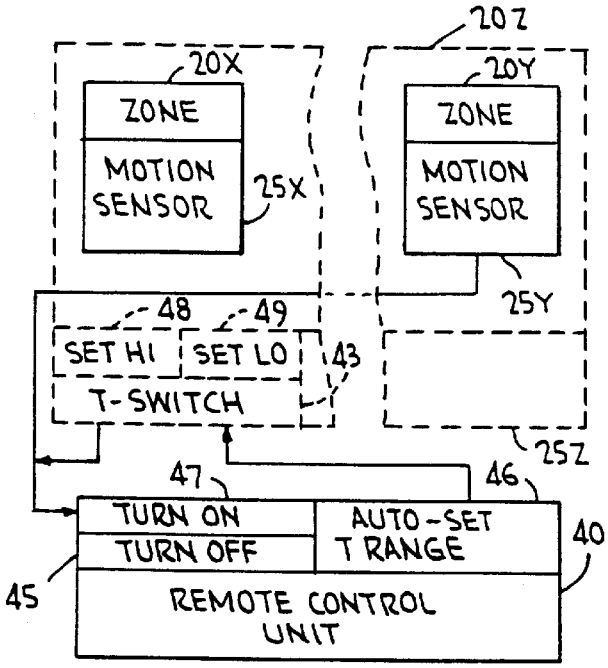
FIG. 5 is a block diagram illustrating a feature of this invention permitting identification of overlapping control zones that respectively control delivery of HVAC energy in response to either a common blanketed temperature range or individually operable motion sensors to control energy delivery as a function of occupancy status in the respective local utility zones of the set.

Particularly in commercial buildings there is a wide range of occupancy conditions, for example in offices, warehousing facilities, on assembly lines, etc. Thus, greater energy savings may be custom tailored by the overlapping of zones in the manner disclosed in FIG. 5. Accordingly a temperature control zone 20Z, outlined in dashed line notation, overlaps a plurality of local zones 20X, 20Y, etc. which include in their control units 25X, 25Y, etc. active occupancy control detection means such as a motion sensor for turning on the automated HVAC energy distribution system channels to the respective local units 25 in the presence of occupancy activity.

Accordingly the T-range settings 43 of the overlapping temperature control zone 20Z serves to override the occupancy control settings of the encompassed local utility control zones 25X, 25Y, etc. Inside the designated temperature range, the HVAC energy supply to the local utility zones 20X, 20Y, etc. may be locally turned off unless occupancy activity is detected. In operation the automatic resetting of the temperature range at 46 may take into account the operating conditions of the temperature control zone 20Z.

Figure 6:
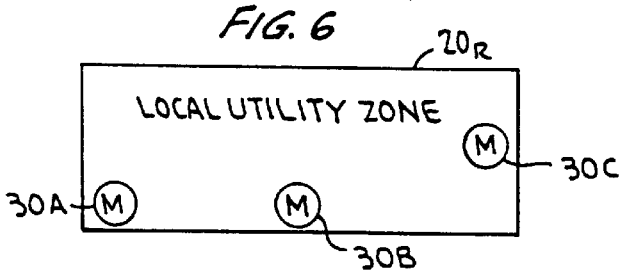
FIG. 6 is a diagrammatic sketch showing a plurality of occupancy detectors active in a single local utility zone.

As indicated in FIG. 6, the occupancy detection in a separate local utility zone 20R may comprise a set of individual occupancy detectors 30, 30A, etc., typically motion detectors M, positioned at different locations in the zone. Operation is controlled so that any one of the motion detectors in that zone may turn on the required HVAC energy supply controls for that zone 20R.

Figure 7:
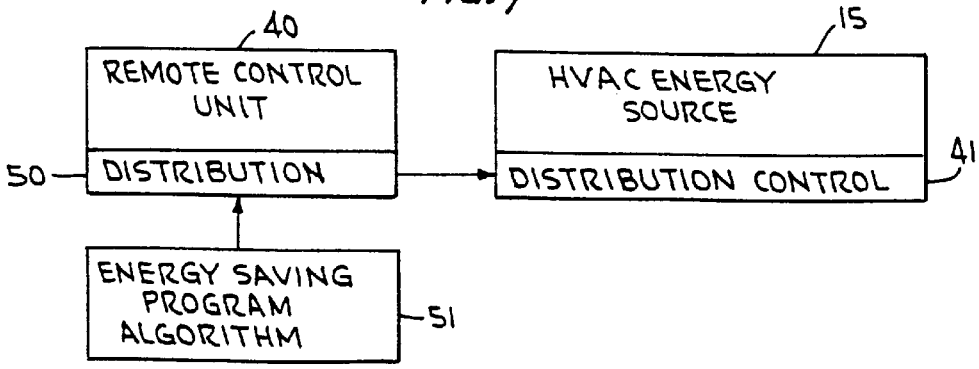
FIG. 7 is a block diagram illustrating a feature of this invention obtaining increased energy savings by orderly control of distribution of available HVAC energy from a central source to a plurality of locally controlled utility zone sites remotely located from the energy source.

The automated system of this invention by way of the programmed remote control unit 40 is focused on energy savings. FIG. 7 sets forth a typical sort of energy saving feature afforded by this invention. Because the overall HVAC energy saving system processes time cycling of the various local utility zones in an energy distribution mode 41, it readily adapts to control of the distribution in accordance with a local algorithm pertinent to a particular system. In this instance, an energy saving programmed algorithm 51 in a distribution section 50 of the remote control unit 40 operates to time or multiplex energy to the various local utility units 20 in the system.

Consider particularly peak load period of an operating day. If an idle factory starts business at a set hour, most local units are apt to require concurrent energy so that the maximum capacity of the HVAC energy source is "worst cased" and is larger than necessary for chronic control conditions. Thus, a control feature for multiplexing during peak demand periods to distribute the power available for a smaller energy source capable of delivering the power necessary for chronic conditions, will assure less chance of down time and will permit a more energy efficient, lower cost HVAC energy source to be employed. Such a programmed algorithm for the particular conditions of each individual system is readily incorporated by those skilled in the programming arts. Thus this invention affords means for distributing energy from a HVAC energy source to those said utility zones currently requiring HVAC energy in a time-sharing pattern that reduces current peak energy delivery requirements and permits a HVAC energy source of reduced peak capacity to be used.

Having therefore set forth improvements in the art, those novel features relating to the spirit and nature of this invention are set forth with particularity in the following claims.

What is claimed is:

1. An automated HVAC control system for saving energy dispensed from a HVAC energy source as a function of occupancy status in a plurality of utility zones dispersed at different locations from the energy source, comprising in combination:

a plurality of inhabitable utility zones having individual energy control means for designating HVAC energy delivery in response to designated control parameters locally established at respective ones of the utility zones, a common HVAC energy source for dispensing HVAC energy to said plurality of utility zones in response to respective local specified operating control parameters, common control means for operating said energy source in response to said designated operating control parameters at a plurality of said utility zones to deliver energy from said common HVAC source to respective ones of said plurality of utility zones, said common control means including a means of reducing peak load capacity requirements of said HVAC control system, occupancy indication means for indicating individual occupancy status within respective ones of said utility zones as one of said designated operating control parameters, and energy delivery means for producing scheduled on-off energy cycles at said plurality of utility zones in response to said common control system in respective individual ones of said utility zones in response to occupancy status established within the respective utility zones.

2. The control system of claim 1 wherein said occupancy indication means comprises occupancy detectors responsive to presence of occupants at the respective utility zones.

3. The control system of claim 1 wherein said occupancy indication means comprises preset timing control means for scheduling occupancy status at the respective utility zones.

4. The control system of claim 1 further comprising cycling means for periodically delivering HVAC energy to individual utility zones during periods of reduced occupancy.

5. The control system of claim 1 wherein said common control means further comprises: communication linking means for communicating between different said utility zones and the common control means, designating means for relaying through the communication linking means to the common control means sets of local control parameters designating zone operating temperatures and temperature ranges designated for controlling local HVAC energy to be delivered from said common energy source, and program control means for said common control means for initiating HVAC energy distribution patterns from said common energy source to implement designated operating temperatures at the plurality of utility zones.

6. The control system of claim 1 wherein said common control means further comprises, means for operating a set of said utility zones to respond to said occupancy indication means to turn on and off energy supplied by said energy delivery means at corresponding said utility zones, a superimposed utility zone encompassing said set of utility zones, and means for controlling the delivery of energy from said energy delivery means to all the utility zones in said set as a function of a temperature operating range to override controls in the utility zones of said set designated by the occupancy indication means.

7. The control system of claim 1 further comprising: temperature control means located in the respective said utility zones for establishing temperature range limits with preset upper and lower temperatures, and means for suppressing energy delivery from said energy delivery means inside said temperature range limits at the respective utility zones.

8. The control system of claim 7 further comprising: operation control means in said common control means for establishing a modified said temperature range parameter overriding said preset temperatures during the course of energy delivery operations thereby to automatically control dynamic temperature operating conditions at the individual utility zones.

9. The control system of claim 1 wherein said occupancy indication means further comprises a set of independent occupancy detectors located in different positions within at least one utility zone, and expanded control means in said common control means to respond to detection of occupancy at any one of the occupancy detectors in said set as an operating control parameter.

10. The control system of claim 1 further comprising: means for establishing an operation control function at said utility zones to initiate automated energy delivery conditions at individual utility zones in response to local temperature outside a locally designated temperature control range.

11. An automated HVAC control system for saving energy dispensed from a common HVAC energy source as a function of locally designated operating control parameters established in a plurality of utility zones dispersed at different locations from the common energy source, comprising in combination:

said plurality of utility zones being adapted for receiving HVAC energy from said energy source for attaining temperatures locally designated at respective ones of the utility zones, common HVAC energy distribution control means for dispensing HVAC energy to said plurality of utility zones in response to said locally designated operating control parameters, said common HVAC energy distribution control means including a means of reducing peak load capacity requirements of said HVAC control system, energy cycling means for producing in response to said common distribution controls means scheduled on-off energy cycles in respective ones of said utility zones responding to the locally designated control parameters established at the respective utility zones, communication linking means for communicating between different ones of said plurality of utility zones and the common control means, designating means for relaying to said control means from said utility zones through the communication linking means sets of local control parameters designating individual utility zone operating temperatures and timing cycles for controlling said energy cycling means, and programmed control means for said common distribution control means for coordinating HVAC energy off-on conditions to implement individual designated operating temperatures and timing cycles at the plurality of utility zones.

* * * * *